US007375276B2

(12) United States Patent
Kanayama et al.

(10) Patent No.: US 7,375,276 B2
(45) Date of Patent: May 20, 2008

(54) PICK-UP SYSTEM AND PROCESS

(75) Inventors: Ryohei Kanayama, Hamamatsu (JP); Yoshifumi Sakai, Hamamatsu (JP); Yasunori Nagaoka, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 135 days.

(21) Appl. No.: 11/007,738

(22) Filed: Dec. 8, 2004

(65) Prior Publication Data

US 2005/0126377 A1 Jun. 16, 2005

(30) Foreign Application Priority Data

Dec. 12, 2003 (JP) ..... 2003-414665

(51) Int. Cl.
*G10H 3/00* (2006.01)

(52) U.S. Cl. ..... 84/723; 84/725; 84/727

(58) Field of Classification Search ..... None
See application file for complete search history.

(56) References Cited

U.S. PATENT DOCUMENTS 4,142,435 A * 3/1979 Pozar ..... 84/727
5,567,903 A * 10/1996 Coopersmith et al. ..... 84/723
2003/0015086 A1* 1/2003 Katz ..... 84/644
2006/0150806 A1* 7/2006 Hara ..... 84/726

FOREIGN PATENT DOCUMENTS

JP 09-166984 6/1997

* cited by examiner

*Primary Examiner*—Marlon T Fletcher
(74) *Attorney, Agent, or Firm*—Foley & Lardner LLP

(57) ABSTRACT

A pick-up system is provided that can be suitably used irrespective of the type of the guitar by means of an arrangement of a plurality of pick-up coils that can appropriately conform to the curvature of the strings that are arranged in a stringed instrument. In accordance with the pick-up system of the present invention, it is possible to adjust the curvature of the roof surfaces of the pick-up coils in conformance with the bending of a pick-up board on which the pick-up coils have been mounted. Therefore, a distance that is always an appropriate distance can be maintained between each of the pick-up coils that are arranged on the pick-up board and each of the strings by means of the suitable adjustment of the curvature of the pick-up board. Accordingly, there is the advantageous result that the vibrations of each of the strings can be appropriately detected irrespective of the type of guitar.

46 Claims, 8 Drawing Sheets

PICK-UP SYSTEM AND PROCESS

CROSS-REFERENCE TO RELATED PATENT APPLICATIONS

Japan Priority Application 2003-414665, filed Dec. 12, 2003 including the specification, drawings, claims, and abstract, is incorporated herein by reference in its entirety.

BACKGROUND OF THE INVENTION

1. Field of the Invention

The present invention relates to a pick-up system that is mounted on a stringed instrument and, in particular, it relates to a pick-up system, which is mounted on a stringed instrument such as a guitar and the like that has a plurality of strings, and can be adjusted such that it is possible to appropriately detect the vibration of each string. Further aspects of the present invention relate to corresponding processes.

2. Related Art

For some time there have been pick-up systems, which are mounted on the body of a stringed instrument such as a guitar and the like, that detect the string vibrations and convert the vibrations into an electrical signal. In particular, the pick-up systems that are used with an electronic stringed instrument, such as a guitar synthesizer and the like, are furnished with a pick-up coil for each string such that the vibrations of each string can be processed individually.

In particular, in Japanese Patent Publication Number 2985061, a pick-up system is cited in which a plurality of pick-up coils are arranged such that the coils have a specified curvature in order to detect the vibration of each string that is arranged on the body of a stringed instrument, such as a guitar and the like. Specifically, the pick-up system that is cited in Japanese Patent Publication Number 2985061 is formed such that it has a specified curvature that is set in advance inside the top case and the bottom case, and the pick-up board, which possesses flexibility, is sandwiched between the top case and the bottom case. As a result, the pick-up coils that are attached to the pick-up board are arranged along the curvature that has been formed on the inside between the top case and the bottom case.

In order for the pick-up system to properly pick up the respective vibrations of each of the strings, it is necessary to appropriately arrange the pick-up coils with respect to each of the strings.

However, for example, in a guitar, the curvature of the string arrangement is different for each type of guitar in conformance with the shapes of each of the finger boards, bridges, and the like. In those cases where pick-up coils that are arranged at a specified curvature are used, such as is cited in Japanese Patent Publication Number 2985061, because the distance between the pick-up coils and the strings becomes unsuitably separated, there has been a problem in that the vibration of the strings cannot be properly picked up.

SUMMARY OF THE DISCLOSURE

The preferred embodiment was made in order to solve the problem discussed above, and has as its object the provision of a pick-up system that can be suitably used irrespective of the type of guitar. This is done by means of an arrangement of a plurality of pick-up coils that can appropriately conform to the curvature of the strings that are arranged in the stringed instrument.

In order to achieve this object, the pick-up system of an embodiment is one in which, in a pick-up system that is arranged in the body section of a stringed instrument for converting the vibrations of a plurality of strings into an electrical signal, the pick-up system is furnished with a plurality of pick-up coils for detecting the vibration of each string among the plurality of strings, and a pick-up board having flexibility on which the plurality of pick-up coils are each arranged independently in the long direction, and a curvature adjustment member with which the curvature of the pick-up board is adjusted by controlling the flexibility of the pick-up board.

The pick-up system in accordance with another embodiment is furnished with a vertical position control member for fixing at least one end section of the region in which the curvature of the pick-up board should be adjusted.

The pick-up system in accordance with another embodiment is one in which the center portion of the region in which the curvature of the pick-up board should be adjusted corresponds to the center portion of the region in which the plurality of pick-up coils have been mounted, and the curvature adjustment member is disposed in the center portion of the region in which the plurality of pick-up coils have been mounted.

The pick-up system in accordance with another embodiment is one in which the curvature adjustment member is one in which the force is made to act in the vertical direction with respect to the surface of the pick-up board.

The pick-up system in accordance with another embodiment is one in which the curvature adjustment member is one in which the force is made to act in a direction that is aligned with the plurality of pick-up coils that have been mounted on the pick-up board.

The pick-up system in accordance with another embodiment is furnished with an elastic member that has been arranged on the side of the surface of the pick-up board that is the reverse of the surface on which the pick-up coils are mounted.

The pick-up system in accordance with another embodiment is one in which the elastic member is a plate spring.

The pick-up system in accordance with another embodiment is one in which the elastic member is a coil spring.

The pick-up system in accordance with another embodiment is furnished with a curvature control member with which the flexibility of the pick-up board is controlled such that the curvature does not become smaller than a specified curvature.

The pick-up system in accordance with another embodiment is furnished with a top case that is arranged on the side of the surface of the pick-up board on which the pick-up coils are mounted, and the curvature control member is a coil spring that has been arranged between the top case and the pick-up board.

In accordance with the pick-up system of a preferred embodiment, it is possible to adjust the curvature of the roof surfaces of pick-up coils by the bending of a pick-up board on which the pick-up coils have been mounted. Therefore, by means of a suitable adjustment of the curvature of the pick-up board, the distance between each of the pick-up coils that are arranged on the pick-up board and each of the strings of a stringed instrument can always be maintained at an appropriate distance. Accordingly, there is the advantageous result that the vibrations of each string can be properly detected irrespective of the type of the guitar.

DETAILED DESCRIPTION OF THE PREFERRED EMBODIMENTS

Figure 1:
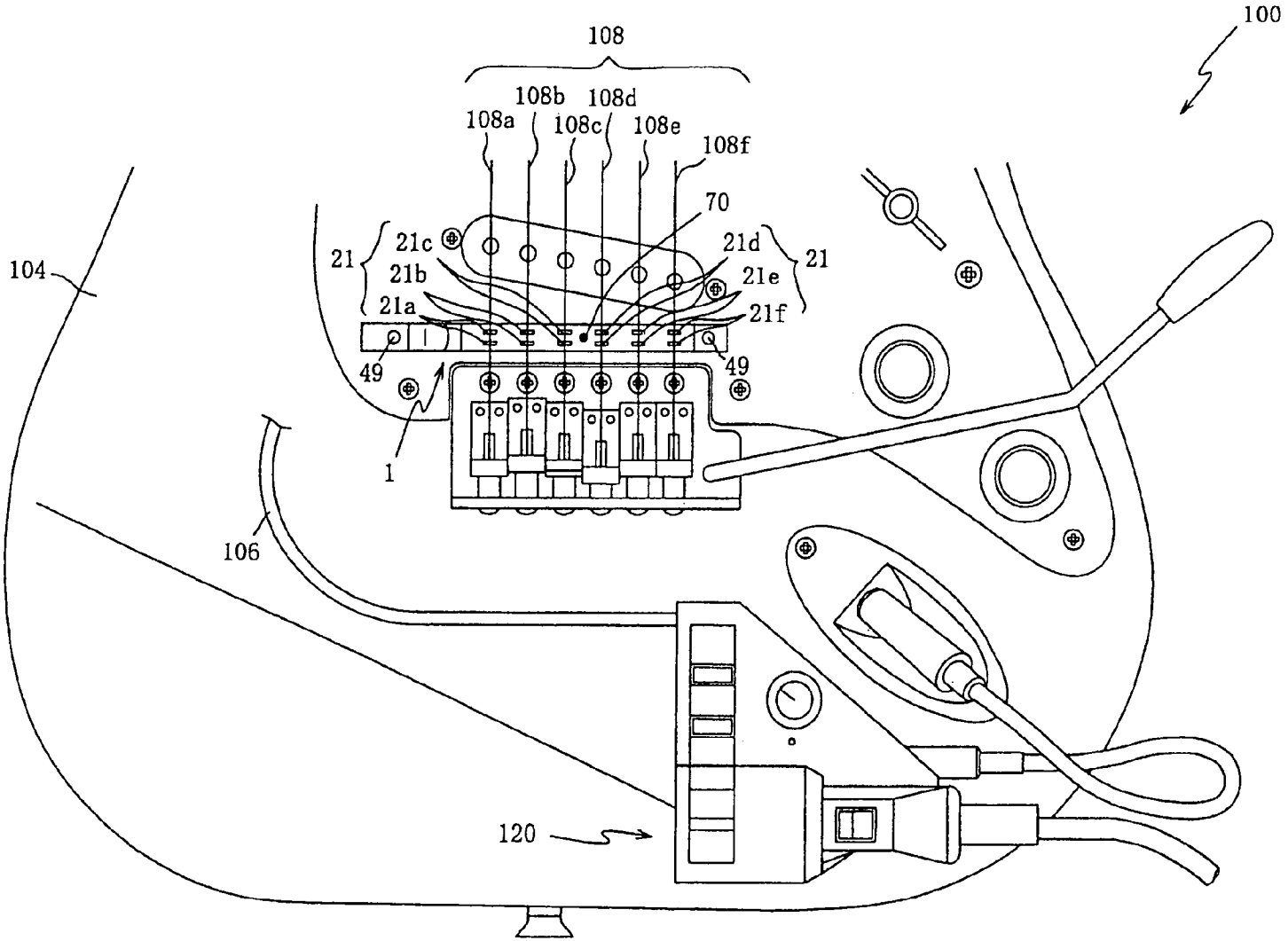
FIG. 1 is a drawing that shows a portion of a guitar on which an example of a pick-up system has been mounted.

An explanation will be given below regarding preferred embodiments while referring to the attached drawings. FIG. 1 is a drawing that shows a portion of the guitar 100 on which the pick-up system 1 has been mounted. As is shown in FIG. 1, the pick-up system is mounted between the six strings 108 that have been disposed on the guitar 100 and the body 104 such that the six pick-up coils 21 (21*a* through 21*f*) are respectively arranged below the strings 108*a* through 108*f*.

Here, in FIG. 1, the drawing shows that the pick-up system 1 is fixed to the body 104 using double sided tape that is not shown in the drawing. However, the system may be fixed by being screwed to the body 104 through the pass-through holes 49 that have been disposed on both sides. The pick-up system that has been mounted as shown in FIG. 1 supplies an electrical signal based on the vibrations of the strings 108*a* through 108*f* that have been picked up by the pick-up coils 21*a* through 21*f* to a control system 120 such as a control system used for a guitar synthesizer and the like via the cable 106.

In addition, in FIG. 1, in order simplify the explanation later, the condition in which the cable 106 is connected to the pick-up system 1 is not shown in the drawing; however, the cable 106 is connected at a specified location (the terminal section 24 that will be discussed later) on a board (the pick-up board 20 that will be discussed later) that is disposed inside the pick-up system 1.

Embodiments of the invention employ a structure that allows users to selectively move the pick-up coils 21 toward or away from the strings 108 of the instrument 100. Example embodiments have pick-up coils 21 disposed on a support member, such as the pick-up board 20, that can be adjusted to change the position of the pick-up coils 21 relative to the strings 108 of the instrument 100. Example embodiments also employ an adjustment member, such as the screw 70, to adjust the support member 20. Such an adjustment could be made, for example, by changing the relative height, the flexure, or the curvature of the support member 20.

Figure 2:
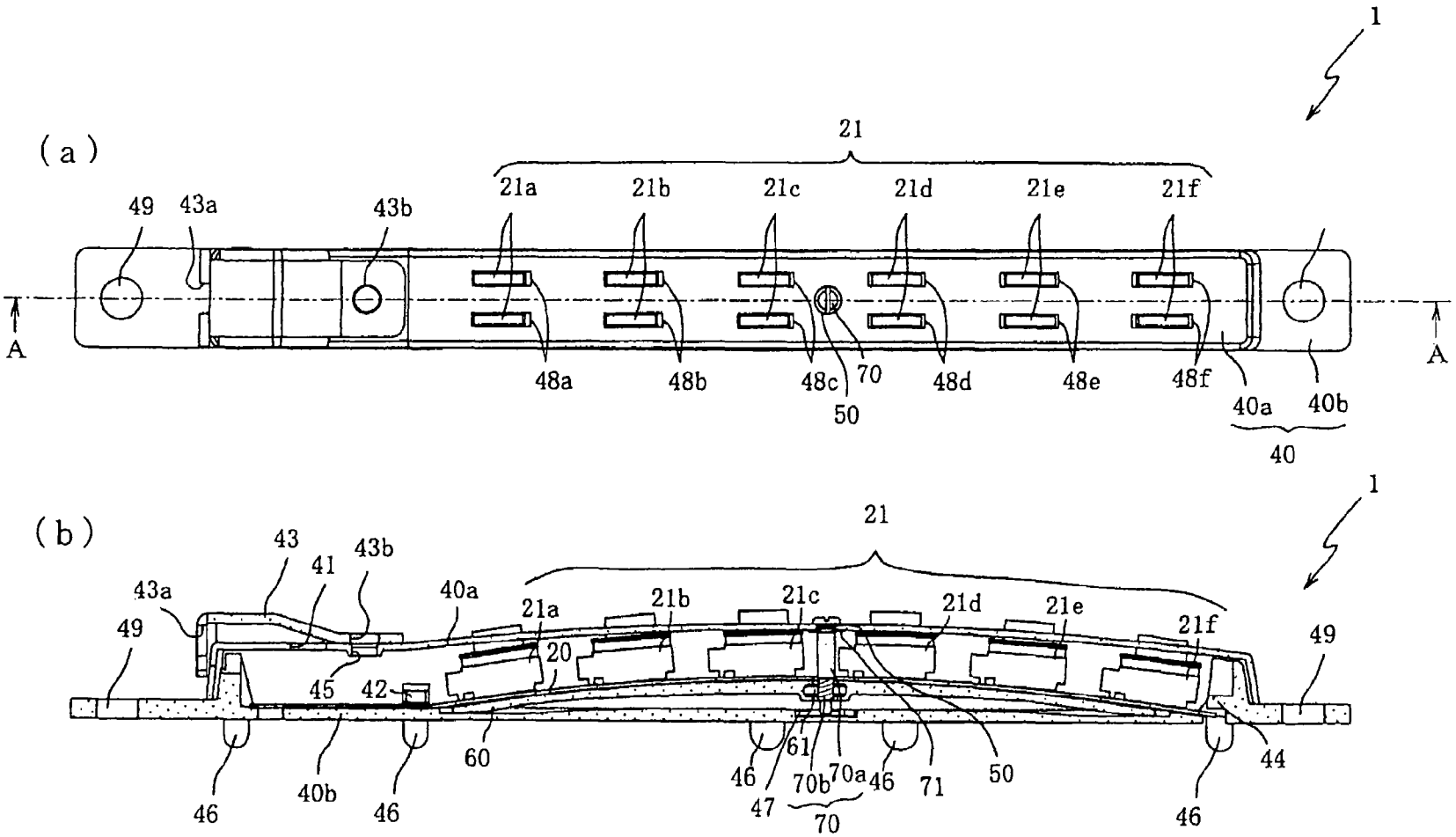
FIG. 2 is a drawing that shows the pick-up system of a first preferred embodiment, (a) is a planar drawing and (b) is a cross-section drawing in the A-A direction of (a)

FIG. 2 is a drawing that shows the pick-up system 1 in a first preferred embodiment of the present invention. FIG. 2(*a*) is a planar drawing of the pick-up system 1 and FIG. 2(*b*) is a cross-section drawing in the direction A-A of FIG. 2(*a*).

The pick-up system 1 is furnished primarily with a support member or pick-up board 20 on which the six pick-up coils 21*a* through 21*f* have been mounted; the top case 40*a* and the bottom case 40*b* that configure the case section 40 for housing the pick-up board 20; the plate spring 60, which is made of resin, that supports the pick-up board 20 from the bottom surface (the surface that is on the side opposite the pick-up coil 21 mounting surface); and the adjusting screw 70 for adjusting the curvature of the pick-up board 20.

The top case 40*a* that configures the upper portion of the case section 40 is formed using a non-magnetic metal such as aluminum. Due to the fact that the top case 40*a* is formed using a non-magnetic metal, the magnetization of the entire top case 40*a* can be prevented and, thus, is preferable in order to be able to prevent mutual interference at the time that the vibrations of each of the strings are detected. In addition, it is preferable, in particular, from the standpoints of processability, strength, and durability that the top case 40*a* be formed using aluminum.

The opening sections 48*a* through 48*f* for exposing a portion of the pick-up coils 21*a* through 21*f*, and the pass-through hole 50 for inserting the adjusting screw 70 with which the curvature of the pick-up board 20 is adjusted are formed on the top area of the top case 40*a*.

In addition, the top case 40*a* is furnished with a cord holder 43 in order to stably hold the cable 106, which is led out to the outside from the pick-up system 1. The cord holder 43 is fixed to the top case 40*a* by means of a screw, which is not shown in the drawing, that is inserted through the screw hole 45 that has been disposed on the top case 40*a* and the screw hole 43*b* that has been disposed on the cord holder 43. Incidentally, the cable 106, which has been connected at a specified location (the terminal section 24 that will be discussed later) on the pick-up board 20, passes through the hole 41, is led out to the inside of the cord holder 43 (between the cord holder 43 and the top case 40*a*), and then is led out to the outside of the pick-up system 1 from the opening section 43*a*.

On the other hand, the bottom case 40*b* is a member that configures the bottom portion of the case section 40 and is formed using a resin such as a polyacetal (POM) and the like. The bottom case 40*b* is furnished with hooks 42 and 44. The pick-up board 20 is mounted on the bottom case 40*b* by mating the corresponding mating sections (the mating sections 25 and 26, which will be discussed later) on the pick-up board 20 to these hooks 42 and 44.

The bottom case 40*b* has downward step shapes (concave sections), that are not shown in the drawing, on both sides in the direction of the width. The bottom case 40*b* with the pick-up board 20 mounted is covered by the top case 40*a* from above. The tab members 46 that are disposed on both sides of the top case 40*a* in the direction of the width are fit into the downward step shaped portions of the bottom case 40*b*. Next, by bending the tab members 46 so that the bottom case 40*b* is covered, the pick-up board is encased between the bottom case 40*b* and the top case 40*a*. Incidentally, in FIG. 2(*b*), in order to simplify the explanation, the tab members 46 of the top case 40*a* are shown in the drawing in the state prior to bending.

Figure 3:
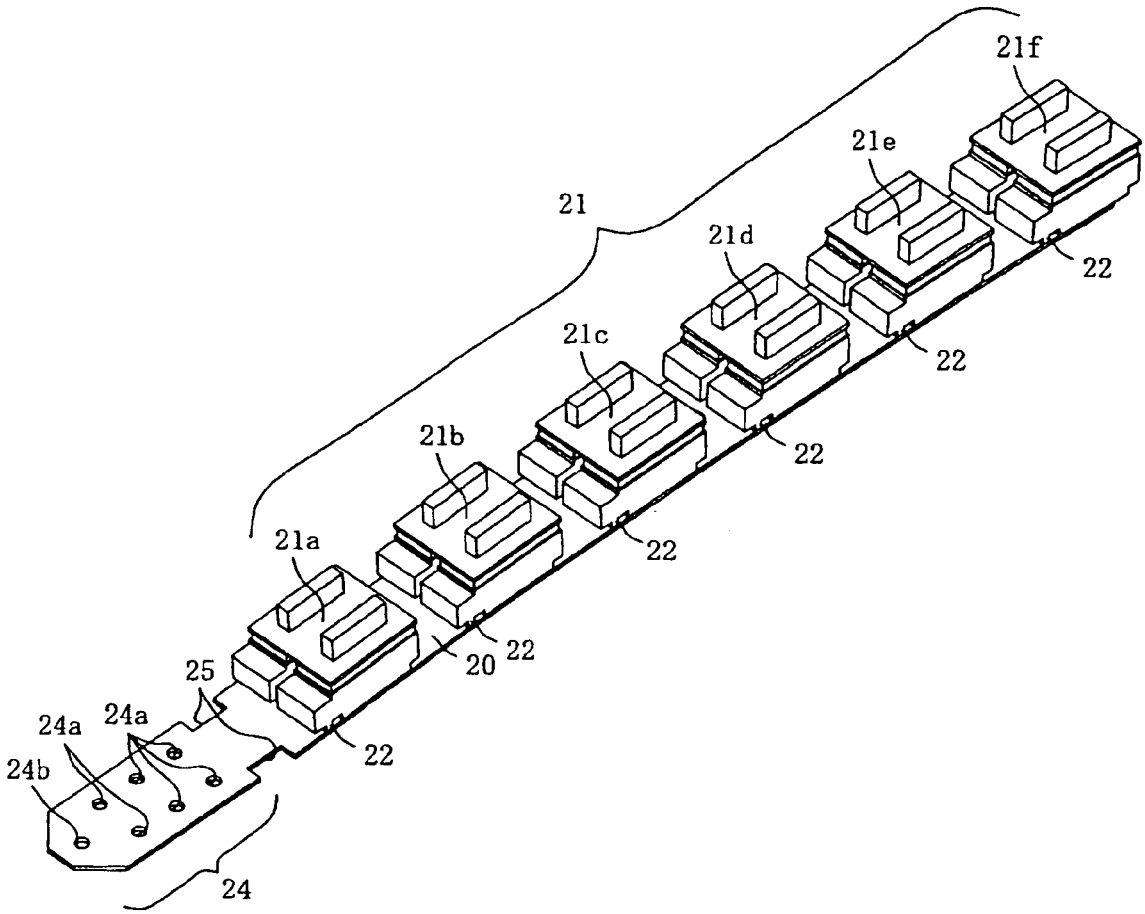
FIG. 3 is a drawing that shows a pick-up board on which the pick-up coils have been mounted.
Figure 4:
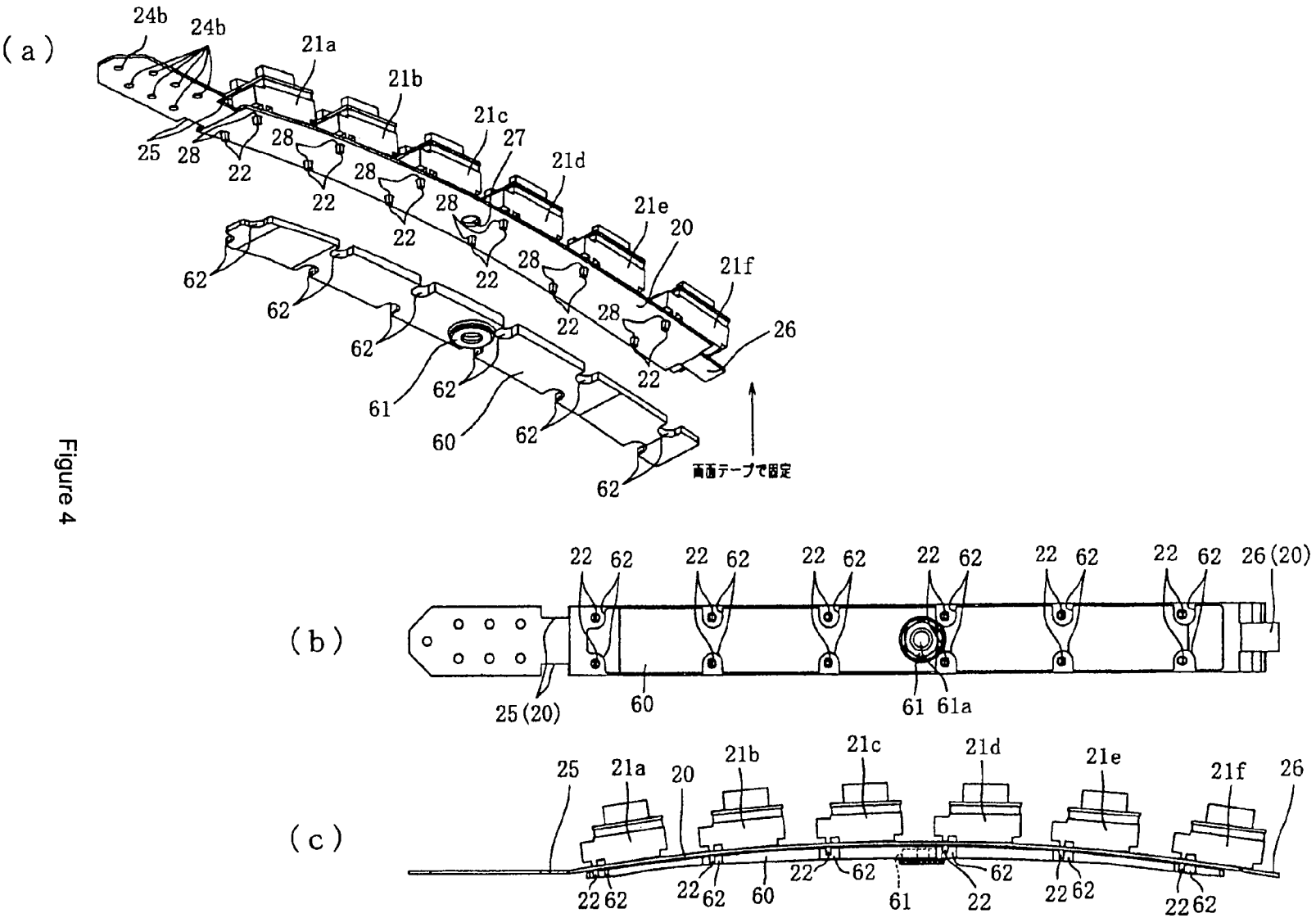
FIG. 4 is a drawing for the explanation of the fastening of the pick-up board and the plate spring, (a) is a drawing that shows the plate spring and the pick-up board that has been arranged on the plate spring disassembled, (b) is a drawing of a fastened pick-up board and plate spring viewed from the rear, and (c) is a lateral surface drawing of a fastened pick-up board and plate spring.

Next, an explanation will be given regarding the pick-up board 20 and the plate spring 60 that supports the pick-up board 20 while referring to FIG. 3 and FIG. 4. FIG. 3 is a drawing that shows the pick-up board 20 on which the pick-up coils 21 have been mounted. FIG. 4 is a drawing for the illustration of the plate spring 60 fastened to the pick-up board 20. FIG. 4(*a*) is a drawing in which the plate spring 60 and the pick-up board 20 that has been arranged on the plate spring 60 are shown disassembled, FIG. 4(*b*) is a drawing that shows the pick-up board 20 and the plate spring 60 fastened, viewed from the rear, and FIG. 4(*c*) is a lateral view of the pick-up board 20 and the plate spring 60 in a fastened state.

The pick-up board 20 is a board having flexibility that has been formed at a thickness of around 0.2 mm from a resin such as a polyester resin or a polyimide resin and the like. As is shown in FIG. 3, the six pick-up coils 21*a* through 21*f* that can detect the respective vibrations of the six strings 108 from the first string 108*a* through the sixth string 108*f* of the guitar 100 are attached on the pick-up board.

The attachment of the pick-up coils 21 to the pick-up board 20 is done, as is shown in FIG. 4(*a*), by inserting the two pins that protrude toward the bottom from each of the pick-up coils 21 (21*a* through 21*f*) into the pass-through holes 28 that have been disposed on the pick-up board 20; and carrying out soldering from the rear surface (that is to say, the surface on the side on which the pick-up coils 21 are not disposed) side of the pick-up board 20. Because of this, it is possible to improve the durability and the reliability of the connections between the pick-up board 20 and the pick-up coils 21 (21*a* through 21*f*).

In addition, the pairs of holes 28 that are formed in the direction of the width of the pick-up board 20 and the pairs of pins 22 of the pick-up coils 21*a* through 21*f* are each disposed at right angles to the direction of the length, which is the flexible direction of the pick-up board 20. Therefore, the flexibility of the pick-up board 20 is not impeded by the mounting of the pick-up coils 21.

As is shown in FIG. 3, a terminal section 24 that is furnished with the six holes 24*a* used for each of the outputs of the pick-up coils 21*a* through 21*f* and the single hole 24*b* used for grounding, is disposed on the left side of the pick-up board 20. The holes 24*a* and the hole 24*b* are connected to the six pairs of holes 28 by means of a conductor pattern that is not shown in the drawing. The lead wires of the cable 106 are each connected to the holes 24*a* and the hole 24*b*, and the electrical signals that are based on the string vibrations that have been detected by the pick-up coils 21*a* through 21*f* are output to the control system 120 via the lead wires and processed in the control system.

The mating sections 25 and 26 for mating the bottom case 40*b* to the pick-up board 20 are respectively disposed to the left of the pick-up coil 21*a* and to the right of the pick-up coil 21*f*. Incidentally, the mating of the mating sections 25 and 26 to the bottom case 40*b* will be discussed in detail later.

Furthermore, the pass-through hole 27 for passing through the adjusting screw 70 for adjusting the curvature of the pick-up board 20 is disposed roughly in the center area on the pick-up board 20 between the pick-up coil 21*c* and the pick-up coil 21*d*. In other words, it is disposed roughly in the center area of the region on which the pick-up coils 21*a* through 21*f* are mounted.

The plate spring 60 is a member for support from the rear surface side such that there is no inappropriate deformation at the time the pick-up board has been bent in order to adjust the curvature. The plate spring 60 is an arch shaped member that has been formed with a curve value of around 150 from a resin such as a polyacetal (POM) and the like. Incidentally, the material of the plate spring 60 is not limited to a POM resin and may be formed from a metal and the like, but from the standpoint of manufacturing cost, processability, and the like, producing the spring from a resin is preferable.

The plate spring 60 and the pick-up board 20 to which the pick-up coils 21 have been attached are, as is shown in FIG. 4(*a*), fastened to each other with double sided tape. However, the fastening method is not limited to double sided tape, and fastening using an adhesive and the like may also be done. Here, because the grooves 62 have each been disposed on the plate spring 60 in the locations that correspond to the pins 22 of the pick-up coils 21 that protrude from the rear surface side of the pick-up board 20, when the pick-up board is fastened to the spring plate 60, as is shown in FIG. 4(*b*), the pins 22 that protrude from the rear surface are not obstructed by the fastening, and it is possible to join them closely to each other.

In addition, in the area that corresponds to the pass-through hole 27 of the pick-up board 20, which is roughly the center portion of the plate spring 60, a nut 61 that has been formed as an insert is disposed on the plate spring 60. When the plate spring 60 and the pick-up board 20 are fastened together, the opening portion 61*a* of the nut 61 is linked through to the pass-through hole 27 of the pick-up board 20.

The adjusting screw 70 that has been inserted from the hole 50 on the top case 40*a* is screwed into the nut 61, and the curvature of the pick-up board 20 in the pick-up system is adjusted in conformance with the extent of the tightening of the adjusting screw 70.

Returning once more to FIG. 2, an explanation will be given regarding the adjustment of the curvature of the pick-up board 20. The adjusting screw 70 is a threaded member that has a cylindrical non-threaded section 70*a* on a portion of the shaft section. The adjusting screw 70 is configured so that it is possible to prevent the screw from falling out of the top case 40*a* by means of the arrangement of a screw slip out preventing member 71 such as a bushing, an E-ring, or an O-ring, and the like in a groove that has been formed between the head surface and the non-threaded section 70*a*.

The threaded portion 70*b* of the adjusting screw 70 is screwed into the opening portion 61*a* of the nut 61 of the plate spring 60 that has been fastened to the pick-up board 20 and when the adjusting screw 70 is rotated so that the screw is tightened with respect to the nut 61, the pick-up board 20 is pulled upward together with this. When this is done, the amount of bending of the pick-up board 20 becomes greater, in other words, the radius becomes smaller. Incidentally, in this case, when the upper surface of the nut 61 that has been formed as an insert on the plate spring 60 comes into contact with the lower edge of the non-threaded section 70*a*, the pick-up board 20 cannot be pulled up any further and, together with being able to inhibit the pick-up board 20 from falling off the hooks 44, it is also possible to prevent damage to the pick-up board 20.

On the other hand, when the adjusting screw 70 is rotated so that the screw is loosened with respect to the nut 61, the pick-up board 20 is pressed downward and lowered together with this. When this is done, the amount of bending of the pick-up board 20 is slackened, in other words, the curvature increases. Incidentally, in this case also, when the nut 61 comes into contact with the bottom surface of the groove section 47 of the bottom case 40*b*, since due to the fact that the threaded portion 70*b* comes out of the nut 61, the pick-up board 20 cannot be pushed downward and lowered any further, it is possible to prevent damage to the pick-up board 20.

Figure 5:
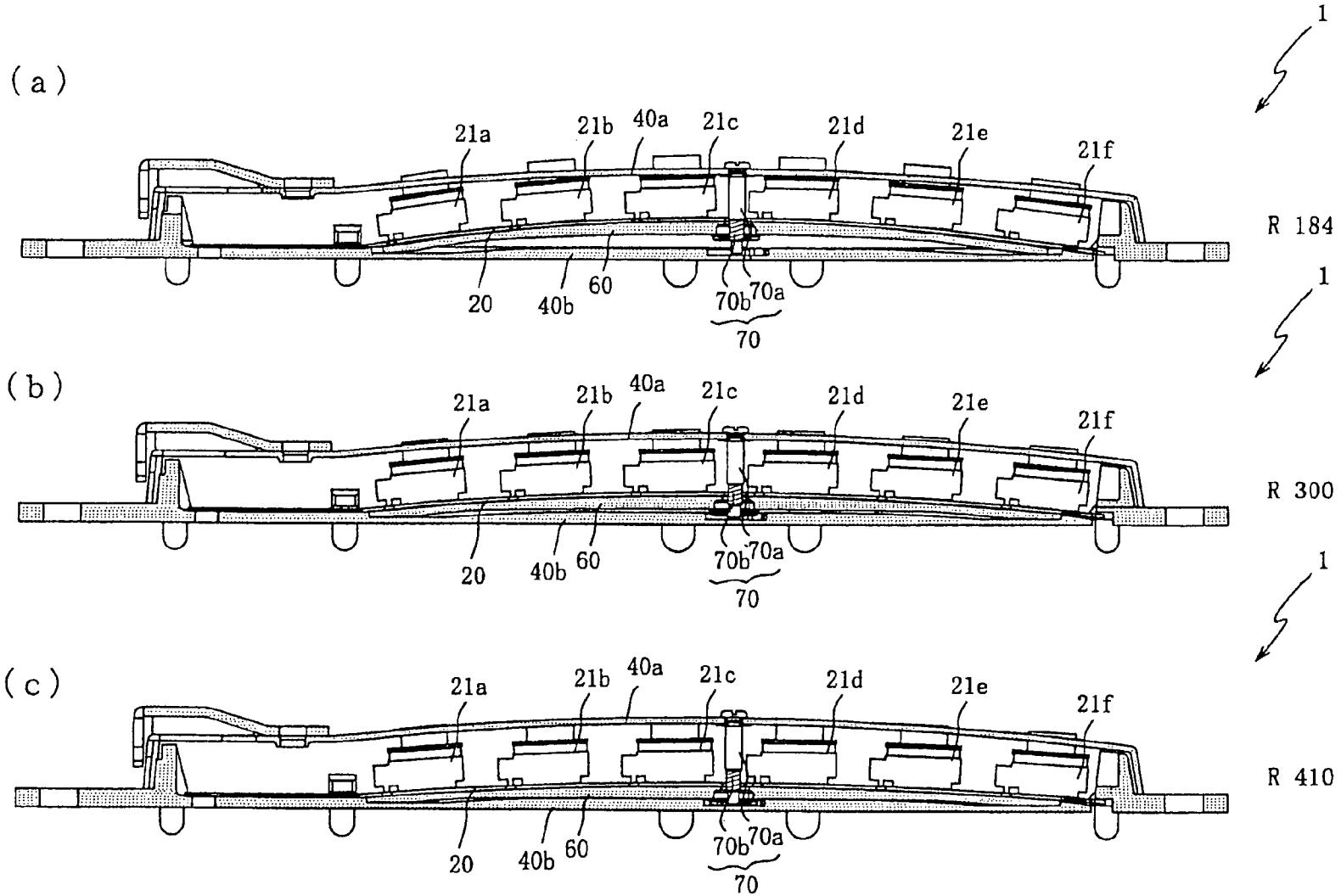
FIG. 5 is a cross-section drawing in the A-A direction of FIG. 2(*a*) and is a drawing for the explanation of the adjustment of the roof surfaces of the pick-up coils in conformance with the extent of the tightening of the adjusting screw, (a) is a drawing that shows the case in which the curvature is 184, (b) is a drawing that shows the case in which the curvature is 300, and (c) is a drawing that shows the case in which the curvature is 410.

FIG. 5 is a cross-section drawing in the A-A direction of FIG. 2(*a*) and is a drawing for the illustration of the adjustment of the curvature of the roof surfaces of the pick-up coils 21 (21*a* through 21*f*) in conformance with the extent of the tightening of the adjusting screw 70. FIG. 5(*a*) is the condition in which the adjusting screw 70 has been tightened as much as possible and, in this case, the curvature (R) of the roof surfaces of the pick-up coils 21 is 184. On the other hand, FIG. 5(*c*) is the condition in which the adjusting screw 70 has been loosened as much as possible and, in this case, the curvature of the roof surfaces of the pick-up coils 21 is 410. FIG. 5(*b*) is a drawing that shows the case in which the curvature of the roof surfaces of the pick-up coils 21 is 300 and it is possible to freely change the curvature of the roof surfaces of the pick-up coils 21 between 184 and 410 in conformance with the extent of the tightening of the adjusting screw 70. Accordingly, with the pick-up system 1 of this preferred embodiment, by means of the application of force to the board surface of the pick-up board 20 in the vertical direction using the adjusting screw 70, the curvature of the roof surfaces of the pick-up coils 21 (21*a* through 21*f*) can be suitably adjusted such that the curvature is appropriate to the curvature of the strings 108.

Figure 6:
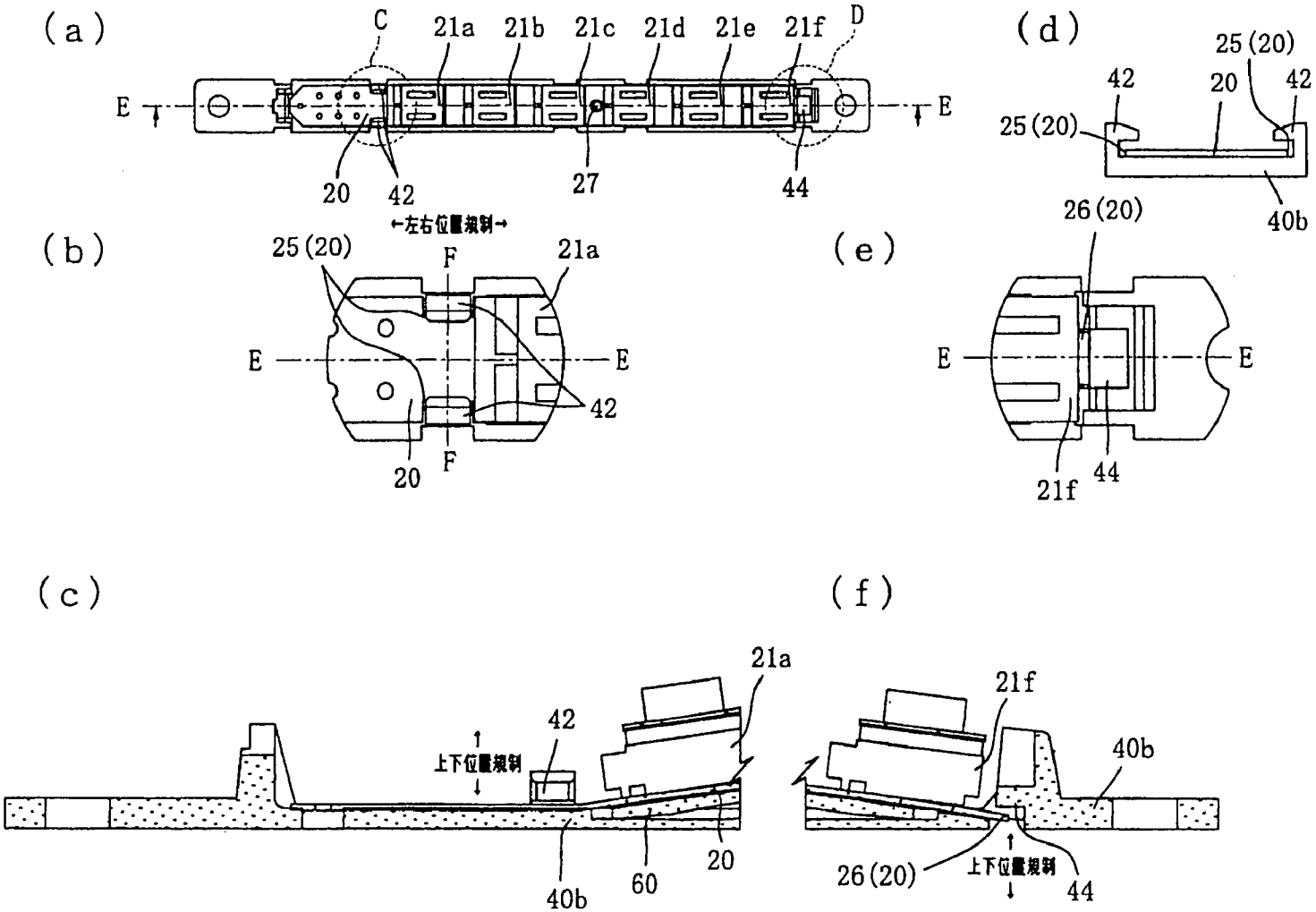
FIG. 6 is a drawing for the explanation of the mating of the pick-up board and the bottom case, (a) is a drawing that shows the condition in which the pick-up board has been mounted on the bottom case, (b) is a partial expanded drawing of the C portion of (a), (c) is a cross-section drawing in the E-E direction of (b), and (d) is a cross-section drawing in the F-F direction of (b); in addition, (e) is a partial expanded drawing of the D portion of (a), and (f) is a cross-section drawing in the E-E direction of (e)

Next, an explanation will be given regarding the mating of the pick-up board 20 to the bottom case 40*b*. FIG. 6(*a*) is a drawing that shows the condition in which the pick-up board 20 has been mounted on the bottom case 40*b*. In addition, FIG. 6(*b*) is a partial expanded upper surface drawing of a portion of the C section of FIG. 6(*a*) that includes the hooks 42. FIG. 6(*c*) is a cross-section drawing in the direction E-E in FIG. 6(*b*) (a portion of the cross-section in the direction E-E in FIG. 6(*a*)), and FIG. 6(*d*) is a cross-section drawing in the direction F-F in FIG. 6(*b*). In addition, FIG. 6(*e*) is a partial upper surface drawing of a portion of the D section of FIG. 6(*a*) that includes the hooks 44 and FIG. 6(*f*) is a cross-section drawing in the direction E-E in FIG. 6(*e*) (a portion of the cross-section drawing in the direction E-E in FIG. 6(*a*)).

With regard to the pick-up board 20, as is shown in FIG. 6, the mating sections 25 and 26 are respectively mated to the hooks 42 and 44 that are formed in a single unit with the bottom case 40*b*. In detail, the hooks 42, which are formed in a pair in the direction of the width in a single unit with the bottom case 40*b* so that they protrude upward are, as is shown in FIG. 6(*d*), hooks that have a cross-section in the direction of the width (a cross-section in the direction F-F) of roughly a reverse "L" shape. As is shown in FIGS. 6(*b*) through (*d*), the pick-up board 20 is mated to the bottom case 40*b* by the fitting of the pair of groove shaped mating sections 25 that have been formed on the pick-up board 20 in the direction of the width into the pair of hooks 42. The left to right position (the direction of the length) of the pick-up board 20 on the bottom case 40*b* is controlled by the hooks 42 in conformance with the size of the grooves of the mating sections 25. In addition, because the hooks 42, as is shown in FIG. 6(*c*) and FIG. 6(D), push on the pick-up board 20 from above, the vertical position is also controlled.

On the other hand, the hooks 44 are also disposed in a single unit with the bottom case 40*b* so that they protrude upward and, as is shown in FIG. 6(*f*), are hooks that have roughly a reverse "L" shape in the cross-section in the direction of the length (the cross-section in the direction E-E). As is shown in FIGS. 6(*e*) and (*f*), the pick-up board 20 is mated to the bottom case 40*b* by fitting the mating sections 26 that are located on the right edge of the pick-up board to the hooks 44. Because the hooks 44, as is shown in FIG. 6(*f*), are pressed into the pick-up board 20 from above, the vertical position of the board is controlled.

Here, since the mating sections 25 and 26 are located on both edges of the region in which the six pick-up coils 21 are arranged on the pick-up board 20 (refer to FIG. 4(*a*)), the hooks 42 and 44 control the vertical position of the region in which the pick-up coils 21 are arranged on the pick-up board 20. Therefore, in those cases where the adjusting screw 70 that has been inserted through the hole 50 on the top case 40*a* is used and, as has been explained before, the curvature of the pick-up board 20 has been changed, since the bending of the pick-up board 20 is changed limited to the region on which the pick-up coils 21 are mounted, the curvature of the roof surfaces of the pick-up coils 21 can be changed with stability.

In addition, the adjusting screw 70 is disposed such that the screw passes through the pass-through hole 27 on the pick-up board 20 that is in roughly the center portion of the region between the mating sections 25 and the mating sections 26, the vertical positions of which are controlled by the hooks 42 and 44 (equivalent to the hole that is linked through to the opening section 61*a* of the nut). Therefore, in those cases where the adjusting screw 70 is rotated so as to tighten or loosen the adjusting screw 70, it is possible to apply force with stability to the pick-up coils 21 mounting region, both edges of which are portions that are controlled vertically. As a result, an appropriate curvature of the roof surface of the pick-up coils 21 can be formed with stability in conformance with the curvature of the strings 108.

As described above, in accordance with the pick-up system 1 of the first preferred embodiment of the present invention, since it is possible to suitably adjust the bending of the pick-up board 20 on which the pick-up coils 21 have been mounted by means of the extent of the tightening of the adjusting screw 70, the curvature of the roof surfaces of the six pick-up coils 21*a* through 21*f* can be suitably adjusted in conformance with the different curvatures of the strings 108 for each type of guitar 100. As a result, it is possible to always maintain a distance between each of the strings 108 and the pick-up coils 21 that is an appropriate distance irrespective of the type of guitar 100, and by that means, to always appropriately detect the vibrations of the strings 108.

Figure 7:
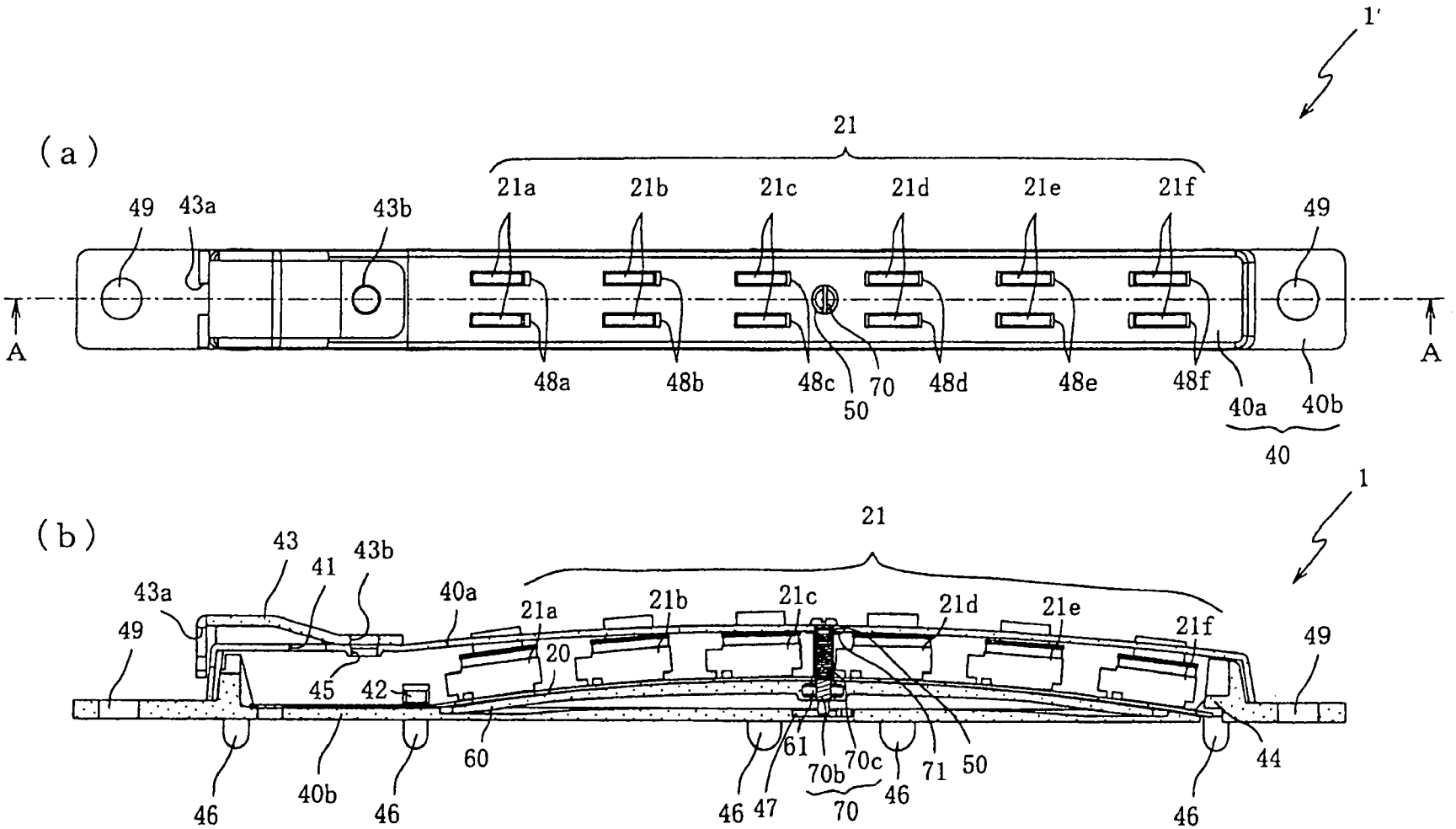
FIG. 7 is a drawing that shows the pick-up system of a second preferred embodiment, (a) is a planar drawing and (b) is a cross-section drawing in the A-A direction of (a)

Next, an explanation will be given regarding a second preferred embodiment of the present invention while referring to FIG. 7. FIG. 7(*a*) is a planar drawing of the pick-up system 1 of the second preferred embodiment, and FIG. 7(*b*) is a cross-section drawing in the A-A direction of FIG. 7(*a*). Incidentally, the identical keys have been assigned to the portions that are identical to those of the first preferred embodiment described before and their descriptions have been omitted.

In the first preferred embodiment described above, a threaded member that has a cylindrical non-threaded section 70*a* on a portion of the shaft section was used as the adjusting screw 70. However, in the second preferred embodiment, a spring member that has been furnished with a compression coil spring 70*c* on the shaft section is used as the adjusting screw 70. The compression coil spring 70*c* is arranged such that the coil spring produces a tightly joined state at the upper limit of the bending of the pick-up board 20, in other words, at the minimum value of the curvature of the pick-up board 20. Because of that, even in those cases where the adjusting screw 70 has been rotated in the tightening direction, the excessive bending of the pick-up board 20, in other words, the excessive reduction of the curvature, can be controlled by means of the force imparted by the compression coil spring 70*c*. Therefore, damage to the pick-up board due to the overtightening of the adjusting screw 70 can be prevented.

Figure 8:
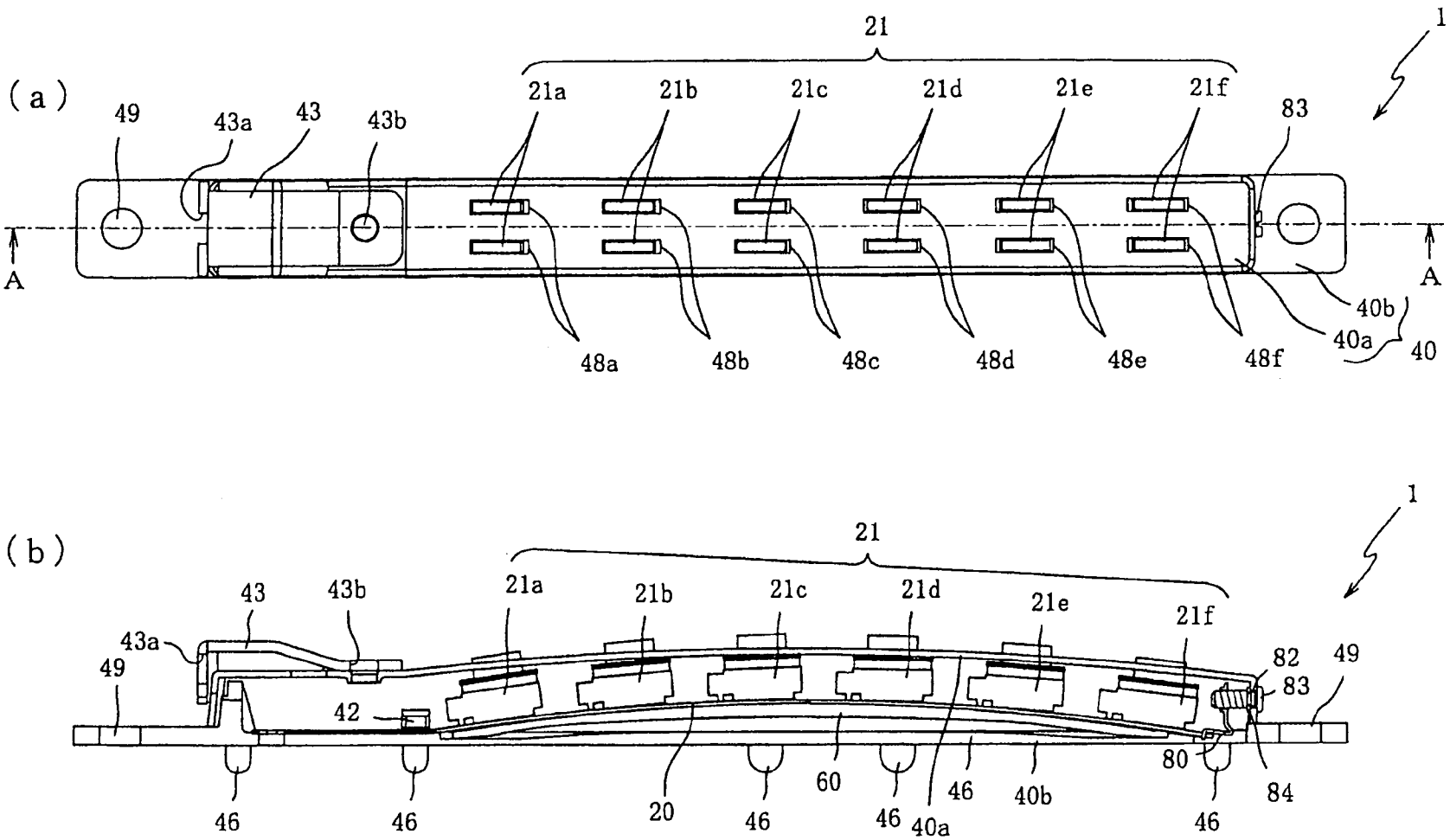
FIG. 8 is a drawing that shows the pick-up system of a third preferred embodiment, (a) is a planar drawing and (b) is a cross-section drawing in the A-A direction of (a).

Next, an explanation will be given regarding a third preferred embodiment of the present invention while referring to FIG. 8. FIG. 8(*a*) is a planar drawing of the pick-up system 1 of the third preferred embodiment, and FIG. 8(*b*) is a cross-section drawing in the direction A-A of FIG. 8(*a*). Incidentally, in the third preferred embodiment also, the identical keys have been assigned to the portions that are identical to those of the first preferred embodiment described before and their descriptions have been omitted.

In the first preferred embodiment described above, it is configured such that the adjusting screw 70 applies a force in the vertical direction with respect to the board surface of the pick-up board 20 and, by this means, the curvature of the pick-up board 20 is changed. However, in the third preferred embodiment, it is configured such that the adjusting screw 83 applies the force in the direction of the length of the pick-up board 20 (the direction aligned with the pick-up coils 21) and, by this means, the curvature of the pick-up board 20 is changed.

In the first preferred embodiment, the nut 61 has been arranged by being formed as an insert in roughly the center portion of the plate spring 60. However, instead of this, in the third preferred embodiment, a screw accepting member 80 that has a nut (not shown in the drawing) inserted is arranged on the edge section that is opposite the side of the terminal section 24 on the pick-up board 20. Instead of the pass-through hole 50 in the first preferred embodiment, the pass-through hole 82 is disposed in a location on the top case 40 that corresponds to that of the screw accepting member 80. The adjusting screw 83 is inserted through the pass-through hole 82 and screwed into the nut of the screw accepting member 80. Incidentally, in the same manner as in the first preferred embodiment, the adjusting screw 83 also is configured so that it is possible to prevent the screw from falling out of the top case 40*a* by means of the arrangement of a screw slip out preventing member 84 such a bushing, an E-ring, or an O-ring, and the like in a groove that has been formed between the head surface and the non-threaded section.

In the third preferred embodiment, in those cases where the adjusting screw 83 is rotated so as to tighten the screw with respect to the nut, the screw accepting member 80 is drawn toward the rear (the rightward side in FIG., 8(*b*)). Together with this, the pick-up board 20 is also drawn toward the rightward side in FIG. 8(*b*) and, as a result, the bending of the pick-up board 20 is relaxed, that is to say, the curvature of the pick-up board becomes larger.

On the other hand, in those cases where the adjusting screw is rotated in a loosening direction, the screw accepting member 80 is pushed toward the front (the leftward side in FIG. 8(*b*)) and, together with this, the pick-up board 20 is also pushed toward the leftward side in FIG. 8(*b*). As a result, the bending of the pick-up board 20*b* increases, that is to say, the curvature of the pick-up board becomes smaller.

As described above, in accordance with the pick-up system 1 in the third preferred embodiment of the present invention, it is possible to suitably adjust the bending of the pick-up board 20 on which the pick-up coils 21 have been mounted by the application of force in the left-right direction (the direction of the length) to the pick-up board 20 using the adjusting screw 83. Therefore, the curvature of the roof surfaces of the six pick-up coils 21*a* through 21*f* can be suitably adjusted in conformance with the different curvatures of the strings 108 of each type of guitar 100. As a result, it is possible to always maintain a distance between each of the strings 108 and the pick-up coils 21 that is an appropriate distance irrespective of the type of guitar 100 and, by that means, to always appropriately detect the vibrations of the strings 108.

An explanation was given above of the present invention based on preferred embodiments; however, the present invention is in no way limited to the preferred embodiments described above and the fact that various modifications and changes are possible that do not deviate from and are within the scope of the essentials of the present invention can be easily surmised.

For example, in these preferred embodiments, it has been configured such that a plate spring 60 is employed as the flexible member that supports the pick-up 20, but it may also be configured such that instead of the plate spring 60, the pick-up board 20 is supported from below by a coil spring. In that case, it may also be arranged with the coil spring supporting the pick-up board 20 from below with the interposition of a plate shaped holding member that holds the pick-up board 20 and also such that the coil spring supports the pick-up board 20.

What is claimed is:

1. A pick-up system that is arranged in the body section of a stringed instrument for converting the vibrations of a plurality of strings into an electrical signal, comprising:

a plurality of pick-up coils for detecting the vibration of each string among the plurality of strings;

a pick-up board having flexibility on which the plurality of pick-up coils are each arranged independently in the long direction; and a curvature adjustment member with which the curvature of the pick-up board is adjusted by controlling the flexibility of the pick-up board.

2. The pick-up system of claim 1, further comprising:

a vertical position control member for fixing at least one end section of the region in which the curvature of the pick-up board is adjusted.

3. The pick-up system of claim 1, wherein:

the center portion of the region in which the curvature of the pick-up board is adjusted corresponds to the center portion of the region in which the plurality of pick-up coils have been mounted; and the curvature adjustment member is disposed in the center portion of the region in which the plurality of pick-up coils have been mounted.

4. The pick-up system of claim 2, wherein:

the center portion of the region in which the curvature of the pick-up board is adjusted corresponds to the center portion of the region in which the plurality of pick-up coils have been mounted; and the curvature adjustment member is disposed in the center portion of the region in which the plurality of pick-up coils have been mounted.

5. The pick-up system of claim 1, wherein the curvature adjustment member is one in which the force is made to act in the vertical direction with respect to the surface of the pick-up board.

6. The pick-up system of claim 2, wherein the curvature adjustment member is one in which the force is made to act in the vertical direction with respect to the surface of the pick-up board.

7. The pick-up system of claim 1, wherein the curvature adjustment member is one in which the force is made to act in a direction that is aligned with the plurality of pick-up coils that have been mounted on the pick-up board.

8. The pick-up system of claim 2, wherein the curvature adjustment member is one in which the force is made to act in a direction that is aligned with the plurality of pick-up coils that have been mounted on the pick-up board.

9. The pick-up system of claim 1, further comprising:

an elastic member that has been arranged on the side of the surface of the pick-up board that is the reverse of the surface on which the pick-up coils are mounted.

10. The pick-up system of claim 2, further comprising:

an elastic member that has been arranged on the side of the surface of the pick-up board that is the reverse of the surface on which the pick-up coils are mounted.

11. The pick-up system of claim 9, wherein the elastic member is a plate spring.

12. The pick-up system of claim 10, wherein the elastic member is a plate spring.

13. The pick-up system of claim 9, wherein the elastic member is a coil spring.

14. The pick-up system of claim 10, wherein the elastic member is a coil spring.

15. The pick-up system of claim 1, further comprising:

a curvature regulating member with which the flexibility of the pick-up board is controlled such that the curvature does not become smaller than a specified curvature.

16. The pick-up system of claim 2, further comprising:

a curvature regulating member with which the flexibility of the pick-up board is controlled such that the curvature does not become smaller than a specified curvature.

17. The pick-up system of claim 15, further comprising:

a top case that is arranged on the side of the surface of the pick-up board on which the pick-up coils are mounted; and wherein the curvature regulating member is a coil spring that is arranged between the top case and the pick-up board.

18. The pick-up system of claim 16, further comprising:

a top case that is arranged on the side of the surface of the pick-up board on which the pick-up coils are mounted; and wherein the curvature regulating member is a coil spring that is arranged between the top case and the pick-up board.

19. A pick-up system for an instrument having at least one string, the system comprising:

an adjustable support member attachable to the instrument at a fixed position on the instrument; and at least one pick-up coil disposed on the support member;

wherein the position of the at least one pick-up coil relative to at least one string of the instrument can be changed by adjusting a shape of the support member attached to the instrument.

20. The system of claim 19, wherein the support member is a pick-up board that is flexible for changing the position of the at least one pick-up coil relative to at least one string by adjusting the degree of flexure.

21. The system of claim 19, further comprising:

a curvature adjustment member for adjusting a curvature of the support member;

wherein the position of the at least one pick-up coil relative to at least one string can be changed by adjusting the curvature of the support member.

22. The system of claim 21, further comprising:

an elastic member arranged on a surface of the support member that is opposite a surface on which the at least one pick-up coil is disposed; and a nut attached to the elastic member;

wherein the curvature adjustment member comprises a screw;

wherein the screw extends through a hole in the support member to the nut; and wherein the curvature of the support member varies based on the extent of the tightening of the screw in the nut.

23. The system of claim 22, wherein tightening the screw in the nut pulls the support member up so that the curvature of the support member becomes smaller as the screw is tightened.

24. The system of claim 22, wherein loosening the screw in the nut presses the support member down so that the curvature of the support member becomes larger as the screw is loosened.

25. The system of claim 22, wherein the screw has a threaded portion and a non-threaded portion;

wherein when the threaded portion comes out of the nut the screw cannot be loosened any further so that the support member can only be lowered up to a predefined limit.

26. The system of claim 22, wherein the tightening of the screw applies a force in a direction that is vertical with respect to a surface of the support member.

27. The system of claim 22, wherein the tightening of the screw applies a force in a direction that is aligned with the at least one pick-up coil on the support member.

28. The system of claim 19, wherein the support member is adjusted by applying a force in a direction that is vertical with respect to a surface of the support member.

29. The system of claim 19, wherein the support member is adjusted by applying a force in a direction that is aligned with the at least one pick-up coil on the support member.

30. The system of claim 19, further comprising:

a position control member for fixing at least one end section of a region of the support member in which the at least one pick-up coil is arranged.

31. The system of claim 30, wherein adjustment of the support member comprises adjusting the curvature of the region of the support member in which the at least one pick-up coil is disposed.

32. The system of claim 19, further comprising;

an elastic member arranged on a surface of the support member that is opposite a surface on which the at least one pick-up coil is disposed.

33. The system of claim 32, wherein the elastic member is a plate spring.

34. The system of claim 32, wherein the elastic member is a coil spring.

35. The system of claim 32, wherein at least one pin protrudes from the at least one pick-up coil and extends through a pass through hole in the support member and is attached on the surface of the support member that is opposite the surface on which the at least one pick-up coil is disposed; and wherein the elastic member has at least one groove in at least one location that corresponds to a location where the at least one pin is attached to the support member.

36. The system of claim 19, further comprising:

a case;

wherein the support member is attachable to the case and the case is attachable to the instrument at a fixed position on the instrument.

37. A method of making a pick-up system for an instrument having at least one string, the method comprising the steps of:

providing at least one pick-up coil;

supporting the at least one pick-up coil on a support member that is attachable to the instrument at a fixed position on the instrument; and changing the position of the at least one pick-up coil relative to at least one string of the instrument by adjusting a shape of the support member attached to the instrument.

38. The method of claim 37, wherein the step of changing the position of the at least one pick-up coil relative to at least one string of the instrument by adjusting the support member attached to the instrument, comprises:

changing the position of the at least one pick-up coil relative to at least one string of the instrument by flexing the support member attached to the instrument.

39. The method of claim 37, wherein the step of changing the position of the at least one pick-up coil relative to at least one string of the instrument by adjusting the support member attached to the instrument, comprises:

changing the position of the at least one pick-up coil relative to at least one string of the instrument by adjusting the curvature of the support member attached to the instrument.

40. The method of claim 37, further comprising the step of:

providing an adjustment member for adjusting the support member.

41. The method of claim 40, wherein the step of changing the position of the at least one pick-up coil relative to at least one string of the instrument by adjusting the support member attached to the instrument, comprises:

changing the position of the at least one pick-up coil relative to at least one string of the instrument by adjusting the adjustment member in order to adjust the support member attached to the instrument.

42. A stringed instrument comprising:

an instrument body;

at least one string supported for vibration on the instrument body; and a pick-up system comprising:

n adjustable support member attached at a fixed position on the instrument body; and at least one pick-up coil disposed on the support member;

wherein the position of the at least one pick-up coil relative to at least one string can be changed by adjusting a shape of the support member.

43. The stringed instrument of claim 42, wherein the support member is a pick-up board that is flexible for changing the position of the at least one pick-up coil relative to at least one string by adjusting the degree of flexure.

44. The stringed instrument of claim 42, wherein the pick-up system further comprises:

an adjustment member for adjusting the support member.

45. The stringed instrument of claim 42, wherein the pick-up system further comprises:

an elastic member arranged on a surface of the support member that is opposite a surface on which the at least one pick-up coil is disposed.

46. The stringed instrument of claim 42, wherein the pick-up system farther comprises:

a case;

wherein the support member is attached to the case and the case is attached at a fixed position on the instrument body.

* * * * *